US007691161B2

(12) United States Patent
Oh et al.

(10) Patent No.: US 7,691,161 B2
(45) Date of Patent: Apr. 6, 2010

(54) CYCLONE DUST-COLLECTING APPARATUS

(75) Inventors: Jang-keun Oh, Gwangju (KR); Seung-yong Cha, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 0 days.

(21) Appl. No.: 12/218,900

(22) Filed: Jul. 18, 2008

(65) Prior Publication Data

US 2009/0193771 A1 Aug. 6, 2009

Related U.S. Application Data

(60) Provisional application No. 61/063,022, filed on Jan. 31, 2008.

(30) Foreign Application Priority Data

Mar. 18, 2008 (KR) ..... 10-2008-0025064

(51) Int. Cl.
*B01D 50/00* (2006.01)

(52) U.S. Cl. ..... 55/337; 55/426; 55/424; 55/413; 55/457; 55/DIG. 3; 15/353

(58) Field of Classification Search ..... 55/337, 55/DIG. 3, 426, 424, 413, 457
See application file for complete search history.

(56) References Cited

U.S. PATENT DOCUMENTS 3,653,644 A * 4/1972 Polysius et al. ..... 34/592
3,724,176 A * 4/1973 Vishnevsky et al. ..... 55/342.2
3,755,914 A * 9/1973 Mark ..... 34/589
3,836,323 A * 9/1974 Engel ..... 432/106
6,406,505 B1 * 6/2002 Oh et al. ..... 55/337
7,018,439 B2 * 3/2006 Vuijk ..... 55/429
7,186,283 B2 * 3/2007 Vuijk ..... 55/343
7,326,268 B2 * 2/2008 Oh et al. ..... 55/343
7,381,233 B2 * 6/2008 Oh et al. ..... 55/318
7,416,575 B2 * 8/2008 Oh et al. ..... 55/416
7,462,212 B2 * 12/2008 Han et al. ..... 55/343
2005/0252179 A1 * 11/2005 Oh et al. ..... 55/337
2006/0080947 A1 * 4/2006 Lee et al. ..... 55/426
2006/0090428 A1 * 5/2006 Park et al. ..... 55/337
2006/0230719 A1 * 10/2006 Han et al. ..... 55/345
2007/0011998 A1 * 1/2007 Yoo et al. ..... 55/337
2007/0119129 A1 * 5/2007 Jeon ..... 55/337
2008/0172994 A1 * 7/2008 Courtney et al. ..... 55/345

(Continued)

FOREIGN PATENT DOCUMENTS

EP 0728435 8/1996

(Continued)

*Primary Examiner*—Jason M Greene
*Assistant Examiner*—Dung Bui
(74) *Attorney, Agent, or Firm*—Ohlandt, Greeley, Ruggiero & Perle, L.L.P.

(57) ABSTRACT

A cyclone dust-collecting apparatus to separate dust from air drawn in through a suction port body of a vacuum cleaner using a centrifugal force and to collect the separated dust is provided. The cyclone dust-collecting apparatus includes a primary cyclone unit to separate dust from air drawn in through the suction port body; a secondary cyclone unit disposed inside the primary cyclone unit to separate dust from air discharged from the primary cyclone unit; and a tertiary cyclone unit disposed above the primary cyclone unit at an angle different from the primary and secondary cyclone units.

13 Claims, 7 Drawing Sheets

U.S. PATENT DOCUMENTS

2008/0190080 A1* 8/2008 Oh et al. ..... 55/343
2008/0223010 A1* 9/2008 Han et al. ..... 55/345

FOREIGN PATENT DOCUMENTS

KR 1020030030302 4/2003
KR 1020050109145 11/2005
KR 1020060040777 5/2006

* cited by examiner

CYCLONE DUST-COLLECTING APPARATUS

CROSS-REFERENCE TO RELATED APPLICATIONS

This application claims the benefit under 35 U.S.C. §119 of U.S. Provisional Patent Application No. 61/063,022, filed on Jan. 31, 2008, in the United States Patent and Trademark Office, and of Korean Patent Application No. 10-2008-25064, filed on Mar. 18, 2008, in the Korean Intellectual Property Office, the entire disclosures of both of which are incorporated herein by reference.

BACKGROUND OF THE INVENTION

1. Field of the Invention

The present disclosure relates to a cyclone dust-collecting apparatus, and more particularly, to a cyclone dust-collecting apparatus used for a vacuum cleaner.

2. Description of the Related Art

Vacuum cleaners generally draw in dust-laden air from a surface being cleaned, and filter the dust from the drawn-in dust-laden air using dust-collecting apparatuses housed therein. Cyclone dust-collecting apparatuses generate a centrifugal force by making the drawn-in dust-laden air whirl thereinside, and separate dust from the air using the generated centrifugal force. Accordingly, cyclone dust-collecting apparatuses can be used permanently because dust bags are not required.

Such cyclone dust-collecting apparatuses include cyclone chambers that cause air laden with dust drawn from outside to whirl thereinside. A single cyclone dust-collecting apparatus generally includes a single cyclone chamber, but it is impossible for a single cyclone chamber to simultaneously separate dust of different sizes. Accordingly, a plurality of cyclone chambers is required, and various technological developments have been made to centrifugally separate dust in two or three stages. However, there is a problem that such multi-cyclone dust-collecting apparatuses increase in volume and weight.

Additionally, if a multi-cyclone dust-collecting apparatus is attached to a cleaner, pressure loss may increase noticeably. The increase in pressure loss may cause the load on a motor generating a suction force to increase, so it may be impossible to operate the cleaner smoothly.

Furthermore, if dust separated by a cyclone dust-collecting apparatus is re-scattered by air currents, the dust-collecting efficiency may deteriorate.

SUMMARY OF THE INVENTION

The present disclosure has been developed in order to solve the above described and other problems in the related art. Accordingly, an aspect of the present disclosure is to provide a compact cyclone dust-collecting apparatus having a high dust-collecting efficiency and low pressure loss.

The above aspect is achieved by providing a cyclone dust-collecting apparatus to separate dust from air drawn in through a suction port body of a vacuum cleaner using a centrifugal force and to collect the separated dust, the cyclone dust-collecting apparatus including a primary cyclone unit to separate dust from air drawn in through the suction port body; a secondary cyclone unit disposed inside the primary cyclone unit to separate dust from air discharged from the primary cyclone unit; and a tertiary cyclone unit disposed above the primary cyclone unit at an angle different from the primary and secondary cyclone units.

The tertiary cyclone unit may be disposed perpendicular to the primary and secondary cyclone units.

The primary cyclone unit may include a cylindrical-shaped body having an inflow pipe formed on one side thereof at a tangent to the body and a space formed thereinside; and a grill pipe disposed substantially in a central portion of the body to simultaneously function as an air outflow opening of the primary cyclone unit and as an air inflow opening of the secondary cyclone unit. The grill pipe may include a skirt to prevent dust separated from air by the primary cyclone unit from being re-scattered, and the skirt may have a plurality of filter pores. A portion of the skirt may be cut out so that large dust may pass through the cut-out portion.

The body may include a dust discharge cover to open or close an open bottom portion of the body. Dust collected in the primary to tertiary cyclone units may be simultaneously discharged through the dust discharge cover.

The secondary cyclone unit may include a secondary cyclone air discharge pipe disposed inside the grill pipe and fluidly communicating with the tertiary cyclone unit; a plurality of guide wings disposed at regular intervals along an outer circumference of the secondary cyclone air discharge pipe; and an isolation pipe disposed below the secondary cyclone air discharge pipe to isolate a lower space inside the body. The plurality of guide wings may be arranged on the same level on the outer circumference of the secondary cyclone air discharge pipe. Additionally, the plurality of guide wings may be disposed at a lower end of the outer circumference of the secondary cyclone air discharge pipe.

The tertiary cyclone unit may include a dual cyclone unit having at least one pair of cyclone chambers disposed symmetrically thereinside; a discharge unit disposed on a first side of the dual cyclone unit to collect air discharged from the pair of cyclone chambers and discharge the air from the tertiary cyclone unit; and a dust-collecting unit disposed on an outer circumference of the body and fluidly communicating with the dual cyclone unit.

The tertiary cyclone unit may further include a cover detachably mounted to the dual cyclone unit to open and close the tertiary cyclone unit, and the cover may have a pair of cylindrical-shaped stabilizers, which are disposed coaxially with a pair of tertiary cyclone air discharge pipes disposed on a second side of the dual cyclone unit. The discharge unit may include an outlet disposed on one side thereof, and the outlet may include a filter mounted thereinside.

The above aspect is also achieved by providing a cyclone dust-collecting apparatus to separate dust from air drawn in through a suction port body of a vacuum cleaner using a centrifugal force and to collect the separated dust, the cyclone dust-collecting apparatus including at least two vertical cyclone units disposed overlappingly; and a horizontal cyclone unit including at least two cyclone chambers disposed parallel to each other and perpendicular to the at least two vertical cyclone units.

An air outflow opening of one of the at least two vertical cyclone units may function as an air inflow opening of the other. The at least two vertical cyclone units may include a grill pipe to simultaneously function as an air outflow opening of one of the at least two vertical cyclone units and as an air inflow opening of the other. The grill pipe may include a skirt extending outwards from a bottom end thereof and having a plurality of filter pores to prevent long and thin contaminants capable of being re-scattered, such as hair, from being caught in and blocking the grill pipe.

One of the at least two vertical cyclone units may fluidly communicate with an air discharge pipe of the horizontal cyclone unit, and the air discharge pipe may include a plurality of guide wings disposed at regular intervals along an outer circumference of the air discharge pipe, so that rotation of air can be accelerated.

Other objects, advantages and salient features of the disclosure will become apparent from the following detailed description and drawings.

BRIEF DESCRIPTION OF THE DRAWING FIGURES

The above aspects and other advantages of the present disclosure will be more apparent by describing the present disclosure with reference to the accompanying drawing figures, in which.

Throughout the drawings, like reference numerals will be understood to refer to like parts, components and structures.

DETAILED DESCRIPTION OF THE INVENTION

Hereinafter, a cyclone dust-collecting apparatus according to an exemplary embodiment of the present disclosure will now be described in greater detail with reference to FIGS. 1 to 7.

Figure 1:
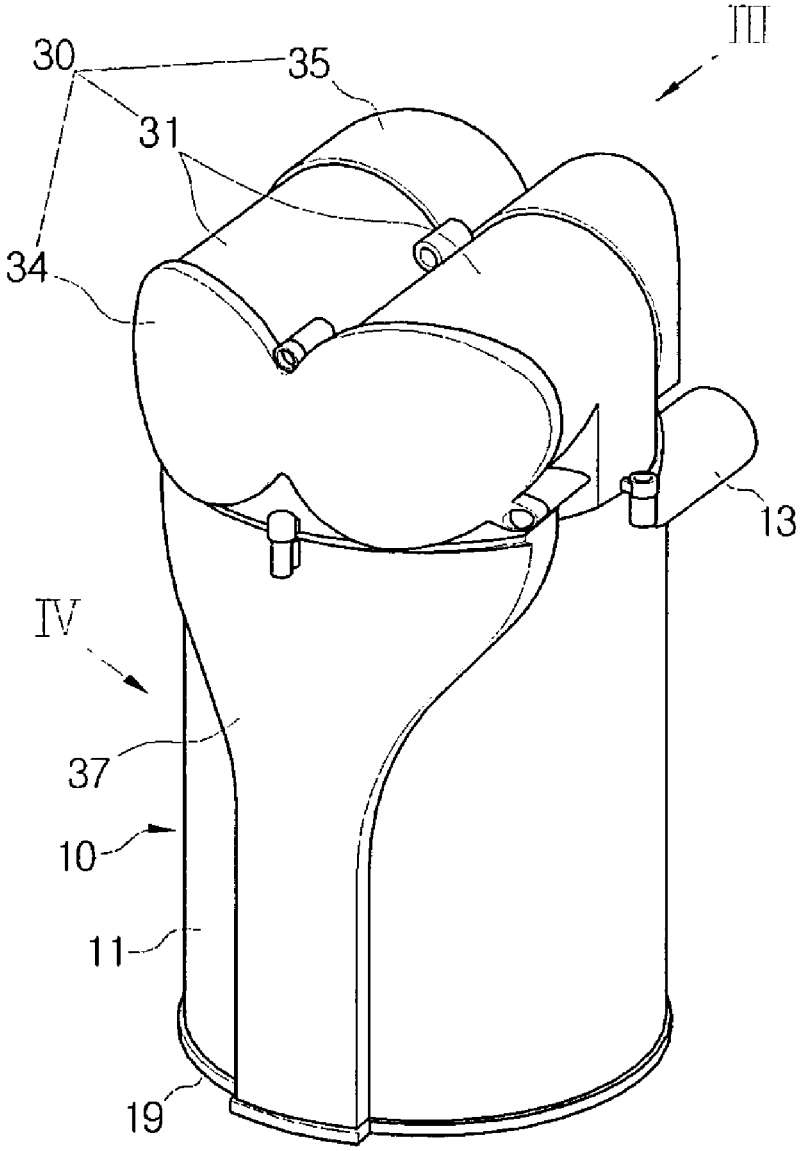
FIG. 1 is a perspective view of a cyclone dust-collecting apparatus according to an exemplary embodiment of the present disclosure.
Figure 2:
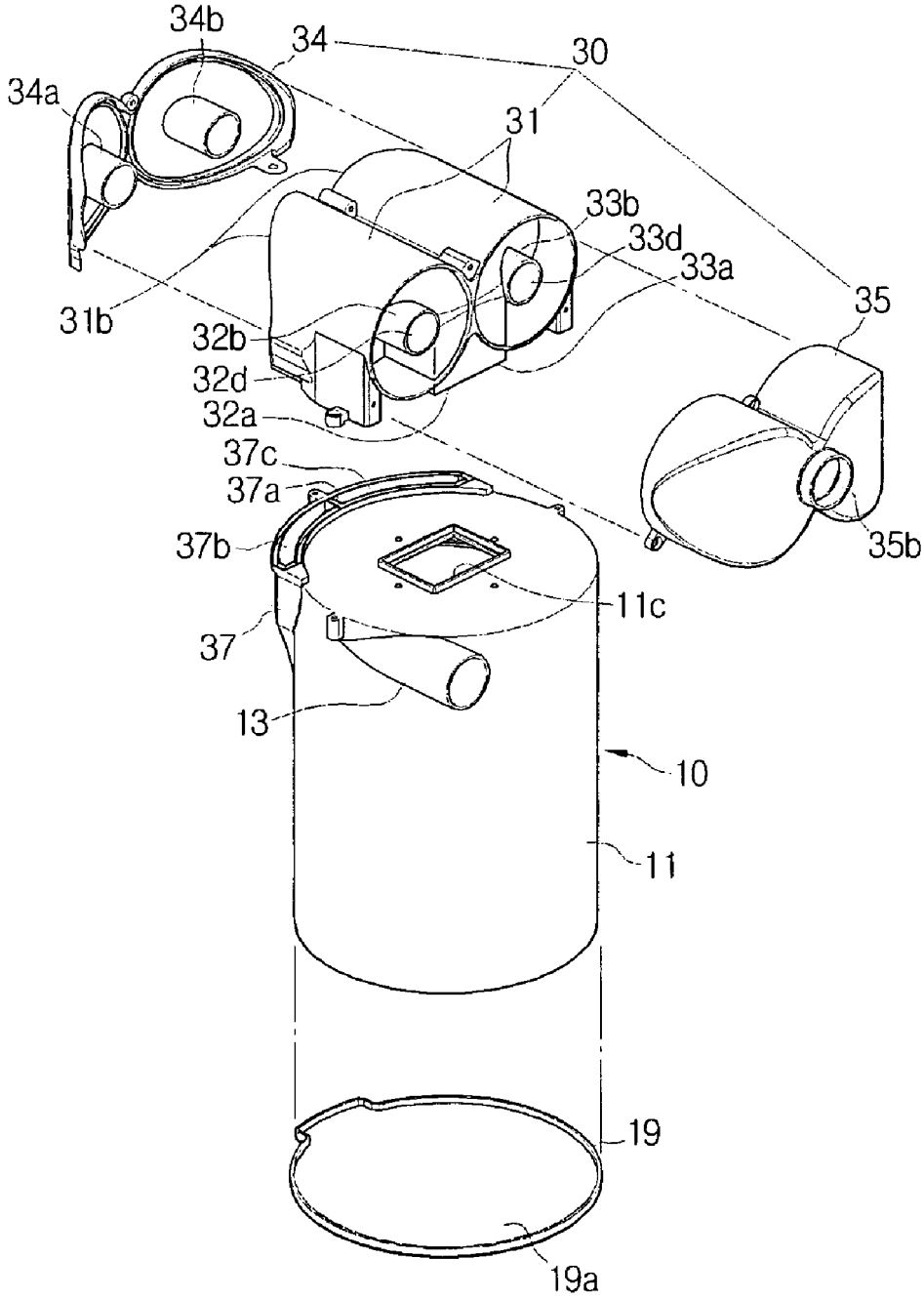
FIG. 2 is an exploded perspective view of the cyclone dust-collecting apparatus illustrated in FIG. 1.
Figure 3:
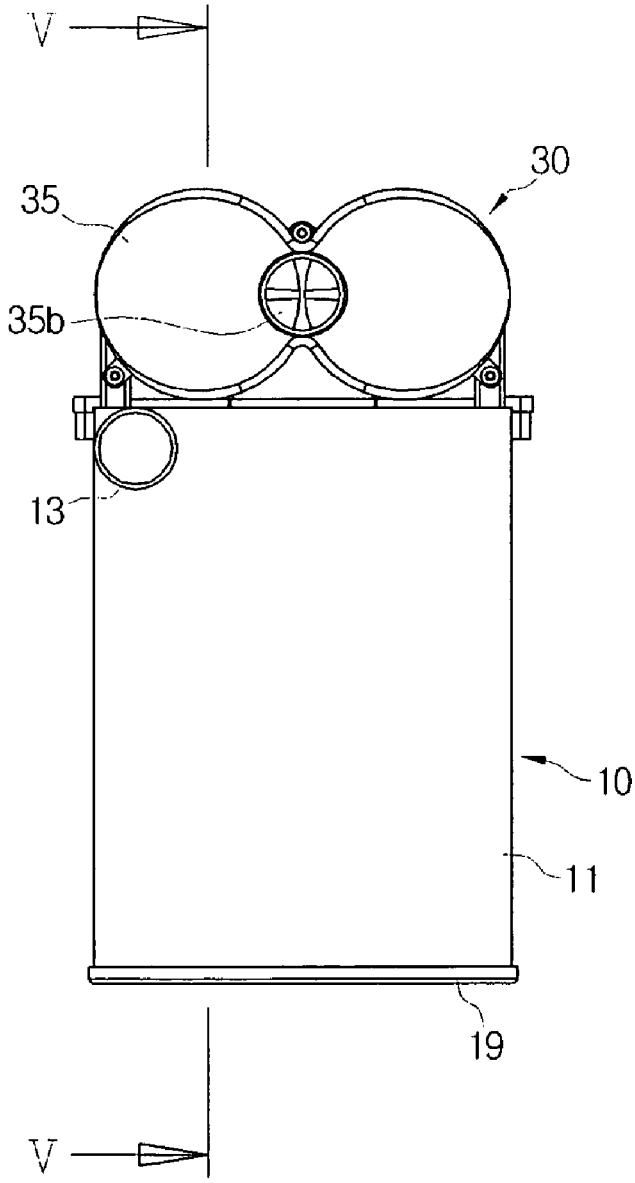
FIG. 3 is a side view taken from the direction indicated by arrow III shown in FIG. 1.
Figure 4:
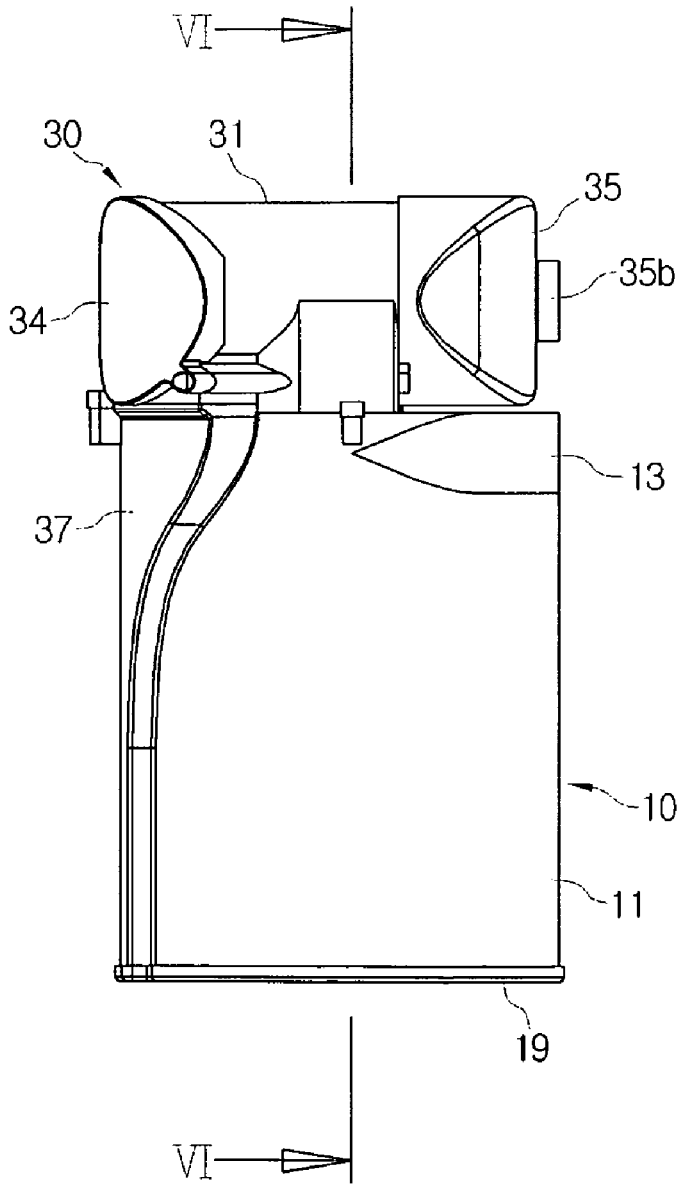
FIG. 4 is a side view taken from the direction indicated by arrow IV shown in FIG. 1.
Figure 5:
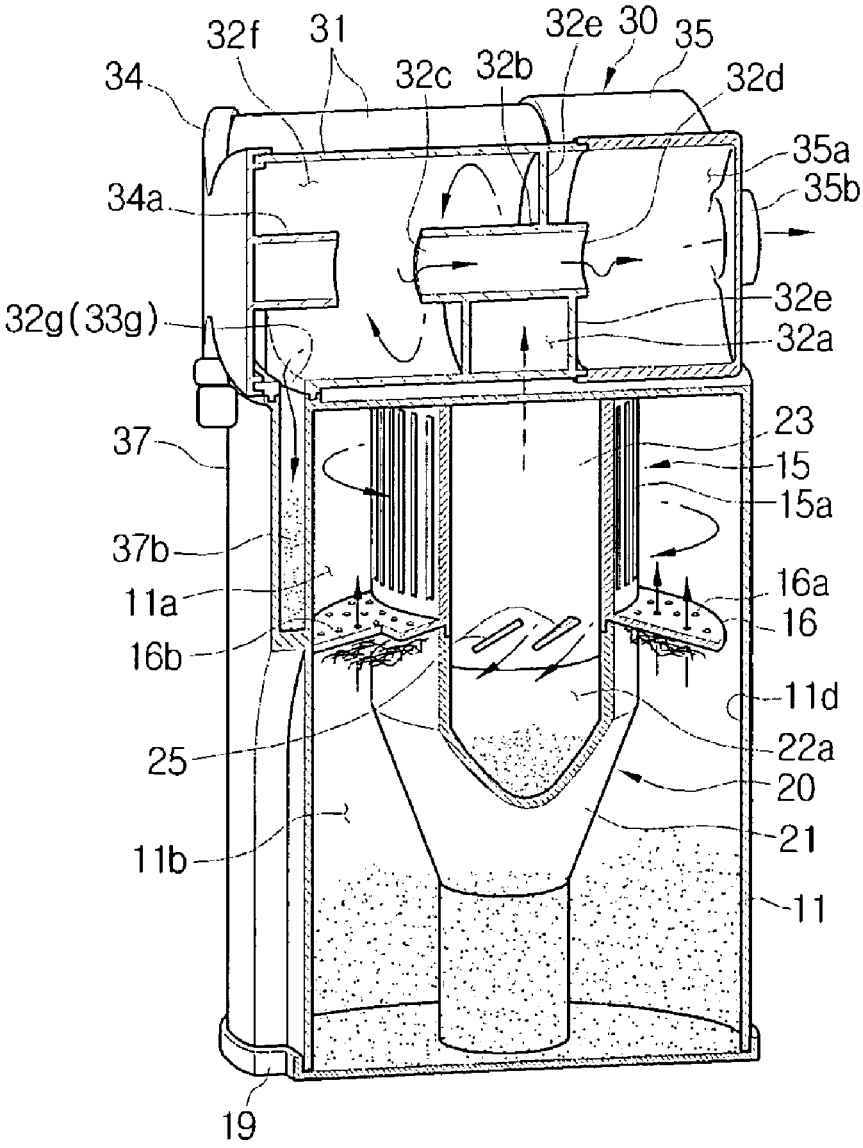
FIG. 5 is a cut-away perspective view taken along line V-V of FIG. 3.

Referring to FIGS. 1 to 7, a cyclone dust-collecting apparatus is used for a vacuum cleaner (not shown) in order to separate dust drawn into a suction port body (not shown) of the vacuum cleaner from air using a centrifugal force and collect the separated dust. Referring to FIGS. 1, 2 and 5, the cyclone dust-collecting apparatus includes a primary cyclone unit 10, a secondary cyclone unit 20 and a tertiary cyclone unit 30. The primary cyclone unit 10 is disposed vertically overlapping with a secondary cyclone unit 20, and the tertiary cyclone unit 30 is disposed substantially perpendicular to the primary and secondary cyclone units 10 and 20.

Referring to FIGS. 2 to 7, the primary cyclone unit 10 separates large dust from air drawn into the primary cyclone unit 10 through the suction port body (not shown). The primary cyclone unit 10 includes a body 11 and a grill pipe 15.

The body 11 is formed in a substantially cylindrical shape, and has a space formed thereinside. An upper portion of the space is used as a primary cyclone chamber 11*a*, and a lower portion thereof is used as a primary dust-collecting chamber 11*b*.

The body 11 includes a discharge hole 11*c* that is formed on the top surface thereof and that fluidly communicates with the tertiary cyclone unit 30. A bottom portion of the body 11 is open, and may be made to open or close by a dust discharge cover 19. Additionally, an inflow pipe 13 protrudes from the upper outer circumference of the body 11 and is disposed at a tangent to the body 11. The inflow pipe 13 guides dust-laden air drawn in through the suction port body (not shown) toward the primary cyclone chamber 11*a*, and simultaneously causes the in-drawn air to whirl so that dust can be smoothly separated from the air.

The grill pipe 15 simultaneously functions as an air outflow opening of the primary cyclone unit 10 and as an air inflow opening of the secondary cyclone unit 20. The grill pipe 15 is disposed inside the primary cyclone chamber 11*a* and securely mounted to the body 11 so that a top end of the grill pipe 15 fluidly communicates with the discharge hole 11*c*. The grill pipe 15 has a plurality of pores 15*a* that are formed on the outer circumference thereof and through which air from which dust has been removed by the primary cyclone chamber 11*a* of the body 11 enters. Accordingly, the air from which dust has been removed by the primary cyclone chamber 11*a* enters between the grill pipe 15 and an secondary cyclone air discharge pipe 23 through the plurality of pores 15*a* of the grill pipe 15, and then flows into the tertiary cyclone unit 30 through the discharge hole 11*c* of the body 11. The plurality of pores 15*a* of the grill pipe 15 are each rectangular in shape like slits in the present exemplary embodiment, but may have various shapes.

A skirt 16 extends outwards from a bottom end of the grill pipe 15, and divides the space of the body 11 into the primary cyclone chamber 11*a* and the primary dust-collecting chamber 11*b*. The outer circumference of the skirt 16 is spaced apart from an inside surface 11*d* of the body 11 at a predetermined distance. The distance between the outer circumference of the skirt 16 and the inside surface 11*d* of the body 11 may be determined so that dust separated by the primary cyclone chamber 11*a* may be discharged to the primary dust-collecting chamber 11*b*. In this situation, the skirt 16 has a cut-out portion 16*b* (see FIG. 7) formed by cutting a certain area of the skirt 16 so that relatively large dust may be discharged smoothly from the primary cyclone chamber 11*a* to the primary dust-collecting chamber 11*b*.

Figure 7:
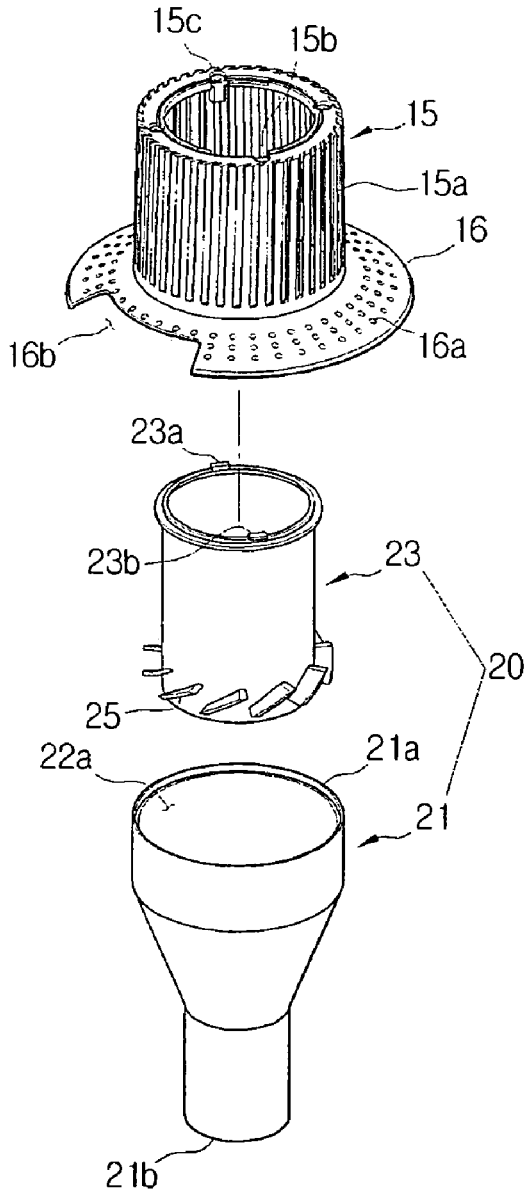
FIG. 7 is an exploded perspective view of a grill pipe and a secondary cyclone unit.

The skirt 16 has a top surface inclined downwards and a plurality of filter pores 16*a* formed therethrough. The plurality of filter pores 16*a* may desirably have a size suitable for filtering long and thin contaminants such as threads, human or pet hair or carpet fluff. The plurality of filter pores 16*a* may have a mesh form. Referring to FIG. 7, the plurality of filter pores 16*a* have extremely small circular shapes, and are disposed in three concentric circles around the grill pipe 15. However, the present disclosure is not limited to such a configuration, and accordingly, the shape and arrangement of the plurality of filter pores 16*a* may vary.

Referring to FIGS. 5 and 7, the secondary cyclone unit 20 includes an isolation pipe 21, a secondary cyclone air discharge pipe 23 and a plurality of guide wings 25.

A top end 21*a* of the isolation pipe 21 is in contact with the bottom end of the grill pipe 15, and a bottom end 21*b* thereof is in contact with a top surface 19*a* (see FIG. 2) of the dust discharge cover 19, in order to isolate the primary dust-collecting chamber 11*b* of the body 11. The isolation pipe 21 tapers downwards, and an upper portion and a lower portion thereof are used as a secondary cyclone chamber 22*a* and as a secondary dust-collecting chamber 22*b*, respectively.

The secondary cyclone air discharge pipe 23 is formed in a substantially cylindrical shape, and disposed inside the grill pipe 15 with a predetermined distance therebetween. Hooks 23*a* and 23*b* formed on a top end of the secondary cyclone air discharge pipe 23 are connected by a snapping motion to mounting grooves 15*b* and 15*c* formed on the top end of the grill pipe 15, so that the secondary cyclone air discharge pipe 23 may be securely fixed to the grill pipe 15. The secondary cyclone air discharge pipe 23 has a length substantially longer than the grill pipe 15, so a bottom end of the secondary cyclone air discharge pipe 23 may be inserted into the upper portion of the isolation pipe 21.

The plurality of guide wings 25 are disposed at regular intervals along the outer circumference of the secondary cyclone air discharge pipe 23, and may desirably be disposed in a lower portion of the secondary cyclone air discharge pipe 23. The plurality of guide wings 25 are inclined in the direction in which the air current whirls. The plurality of guide wings 25 cause the air current whirling along the secondary cyclone air discharge pipe 23 to rotate, so the centrifugal force may be added to the air current discharged from the plurality of guide wings 25. Accordingly, it is possible to accelerate the operation of separating fine dust from air inside the secondary cyclone chamber 22*a*.

Figure 6:
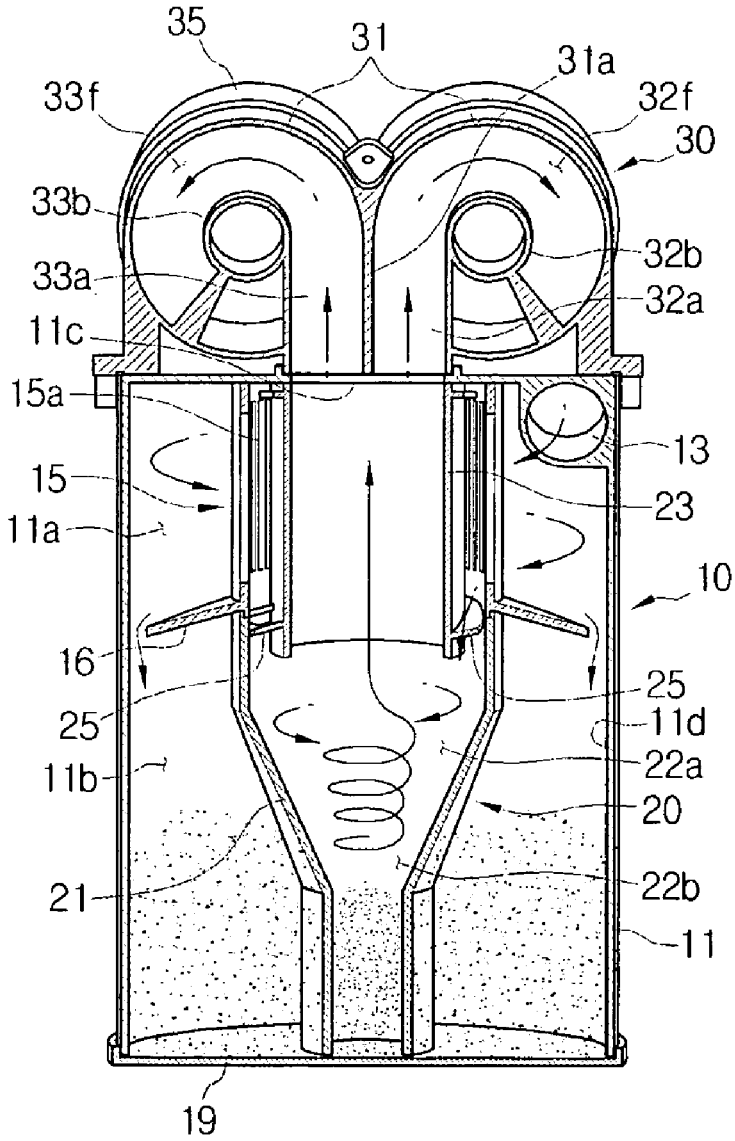
FIG. 6 is a cut-away perspective view taken along line VI-VI of FIG. 4.

Referring to FIGS. 2, 5 and 6, the tertiary cyclone unit 30 is disposed perpendicular to the primary and secondary cyclone units 10 and 20. Such arrangement of the cyclone units 10, 20 and 30 helps to reduce the total length of the cyclone dust-collecting apparatus, so it is possible to implement a compact cyclone dust-collecting apparatus. While the tertiary cyclone unit 30 is disposed perpendicular to the primary and secondary cyclone units 10 and 20 in this exemplary embodiment, there is no limitation thereto. Accordingly, the angle between the tertiary cyclone unit 30 and the primary and secondary cyclone units 10 and 20 may change, taking into consideration the compactness of the cyclone dust-collecting apparatus.

The tertiary cyclone unit 30 includes a dual cyclone unit 31, a cover 34 for opening and closing the tertiary cyclone unit 30, a discharge unit 35 and a dust-collecting unit 37.

The dual cyclone unit 31 includes a pair of suction ducts 32*a* and 33*a* that are formed on a lower portion thereof and that fluidly communicate with the discharge hole 11*c* of the body 11. Additionally, the dual cyclone unit 31 includes a pair of tertiary cyclone chambers 32*f* and 33*f* that are formed thereinside and by which fine dust is centrifugally separated from air drawn in through the pair of suction ducts 32*a* and 33*a*. The suction duct 32*a* and tertiary cyclone chamber 32*f* are separated from the suction duct 33*a* and tertiary cyclone chamber 33*f* by a first partition wall 31*a* in a substantially symmetrical array. The dual cyclone unit 31 also includes a pair of tertiary cyclone air discharge pipes 32*b* and 33*b* disposed substantially in the center of the pair of tertiary cyclone chambers 32*f* and 33*f*, respectively. First sides 32*c* and 33*c* of the pair of tertiary cyclone air discharge pipes 32*b* and 33*b* fluidly communicate with the pair of tertiary cyclone chambers 32*f* and 33*f*, and second sides 32*d* and 33*d* thereof fluidly communicate with the discharge unit 35.

The dual cyclone unit 31 includes an opening unit 31*b* formed on a first side thereof, and walls 32*e* and 33*e* formed on a second side thereof to separate the discharge unit 35 and the pair of tertiary cyclone chambers 32*f* and 33*f*. Additionally, the dual cyclone unit 31 includes a pair of dust discharge ports 32*g* and 33*g* formed below the opening unit 31*b* in order to discharge fine dust separated by the pair of tertiary cyclone chambers 32*f* and 33*f*.

The cover 34 for opening and closing the tertiary cyclone unit 30 is detachably connected to the opening unit 31*b* of the dual cyclone unit 31, and includes stabilizers 34*a* and 34*b* disposed coaxially with the pair of tertiary cyclone air discharge pipes 32*b* and 33*b*. The stabilizers 34*a* and 34*b* are substantially cylindrical in shape, and maintain the force required to make air currents to whirl from the pair of tertiary cyclone chambers 32*f* and 33*f* towards the cover 34.

The discharge unit 35 is detachably connected to the second side of the dual cyclone unit 31, and includes a space 35*a* and an outlet 35*b*. The space 35*a* is formed inside the discharge unit 35 in order to collect dust-removed air that is discharged via the pair of tertiary cyclone air discharge pipes 32*b* and 33*b* of the dual cyclone unit 31. The outlet 35*b* is disposed on one side of the discharge unit 35 in order to discharge the air collected in the space 35*a* externally. Additionally, the discharge unit 35 may include a filter, for example a sponge filter (not shown), mounted in the space 35*a* in order to increase the air filtering efficiency.

The dust-collecting unit 37 protrudes lengthwise from the outer circumference of the body 11. The dust-collecting unit 37 fluidly communicates with the pair of dust discharge ports 32*g* and 33*g* of the dual cyclone unit 31, and includes a pair of tertiary dust-collecting chambers 37*b* and 37*c* divided by a second partition wall 37*a*.

Hereinafter, the operation of the cyclone dust-collecting apparatus of the present disclosure is described now with reference to FIGS. 5 and 6.

When dust-laden air drawn in through the inflow pipe 13 of the primary cyclone unit 10 is made to whirl inside the primary cyclone chamber 11*a* of the body 11 along the inside surface 11*d* of the body 11, dust is separated from air by the centrifugal force. Air from which dust has been separated is then discharged to a space formed between the inside surface 11*d* of the body 11 and the outer circumference of the skirt 16, and the discharged air is collected in the primary dust-collecting chamber 11*b*. Relatively large dust is collected in the primary dust-collecting chamber 11*b* through the cut-out portion 16*b* of the skirt 16. Additionally, if long and thin contaminants, such as human or pet hair, collected in the primary dust-collecting chamber 11*b* is re-scattered, the long and thin contaminants are caught in the plurality of filter pores 16*a* of the skirt 16, so it is possible to prevent the plurality of pores 15*a* of the grill pipe 15 from becoming blocked.

Air from which dust has been separated flows into the plurality of pores 15*a* of the grill pipe 15. In this situation, dust having a size greater than the plurality of pores 15*a* may be prevented from flowing into the secondary cyclone unit 20.

Air passing through the grill pipe 15, and relatively small dust contained in air that has not been filtered by the primary cyclone unit 10, are made to whirl downwards along the outer circumference of the secondary cyclone air discharge pipe 23 of the secondary cyclone unit 20.

The air and the relatively small dust have an increased whirling force while passing through the plurality of guide wings 25, and enter the secondary cyclone chamber 22*a*. The relatively small dust is then separated from the air by the centrifugal force and is collected in the secondary dust-collecting chamber 22*b*.

Air from which the relatively small dust has been separated flows into the tertiary cyclone unit 30 through the secondary cyclone air discharge pipe 23 and via the discharge hole 11*c* of the body 11.

The air flowing into the tertiary cyclone unit 30 is made to whirl along the pair of suction ducts 32*a* and 32*b* while entering the pair of tertiary cyclone chambers 32*f* and 33*f* of the dual cyclone unit 31. As described above, the tertiary cyclone unit 30 has a dual type, so it is possible to reduce pressure loss, and thus the suction force may be maintained.

The air entering the pair of tertiary cyclone chambers 32*f* and 33*f* is made to whirl towards the cover 34. In this situation, fine dust contained in air that has not yet been separated is separated from the air by the centrifugal force. The fine dust separated from the air is discharged via the pair of dust discharge ports 32*g* and 33*g* and the discharged dust is then collected in the pair of tertiary dust-collecting chambers 37*b* and 37*c* of the dust-collecting unit 37.

Air from which the fine dust has been separated by the pair of tertiary cyclone chambers 32*f* and 33*f* flows into the space 35*a* of the discharge unit 35 through the pair of tertiary cyclone air discharge pipes 32*b* and 33*b*, and is then discharged outwards from the tertiary cyclone unit 30 via the outlet 35*b* of the discharge unit 35.

In order to discharge dust collected in the primary to tertiary dust-collecting chambers 11*b*, 22*b*, 37*b* and 37*c*, when the dust discharge cover 19 connected to the bottom of the body 11 is detached from the body 11, the primary to tertiary dust-collecting chambers 11*b*, 22*b*, 37*b* and 37*c* are concurrently opened to discharge dust.

The cyclone dust-collecting apparatus according to the exemplary embodiment of the present disclosure may filter dust according to its size using the primary and tertiary cyclone units 10, 20 and 30 in multiple stages, so the dust-collecting efficiency may be maximized.

Additionally, the dual cyclone unit 31 of the tertiary cyclone unit 30 causes pressure loss to be reduced, so it is possible to prevent a decrease in the suction force.

As described above, according to the exemplary embodiment of the present disclosure, drawn-in air and dust may be separated three times, and accordingly the air filtering efficiency may be greatly increased.

Furthermore, since the tertiary cyclone unit is disposed perpendicular to the primary and secondary cyclone units, the cyclone dust-collecting apparatus may maintain a compact form. Additionally, it is possible to prevent pressure loss from being reduced by the pair of cyclone chambers disposed parallel in the tertiary cyclone unit, and thus it is possible to prevent the suction force to be reduced, so the dust-collecting efficiency can be increased.

Although representative exemplary embodiment of the present disclosure has been shown and described in order to exemplify the principle of the present disclosure, the present disclosure is not limited to the specific exemplary embodiment. It will be understood that various modifications and changes can be made by one skilled in the art without departing from the spirit and scope of the disclosure as defined by the appended claims. Therefore, it shall be considered that such modifications, changes and equivalents thereof are all included within the scope of the present disclosure.

What is claimed is:

1. A cyclone dust-collecting apparatus to separate dust from air using a centrifugal force and to collect the separated dust, the cyclone dust-collecting apparatus comprising:

a primary cyclone unit to separate dust from air;

a secondary cyclone unit disposed inside the primary cyclone unit to separate dust from air discharged from the primary cyclone unit; and a tertiary cyclone unit disposed above the primary cyclone unit at an angle different from the primary and secondary cyclone units, wherein the primary cyclone unit comprises:

a cylindrical-shaped body having an inflow pipe formed on one side thereof at a tangent to the cylindrical-shaped body and a space formed thereinside; and a grill pipe disposed substantially in a central portion of the cylindrical-shaped body to simultaneously function as an air outflow opening of the primary cyclone unit and as an air inflow opening of the secondary cyclone unit, wherein the grill pipe comprises a skirt to prevent dust separated from air by the primary cyclone unit from being re-scattered, and wherein the skirt has a plurality of filter pores.

2. The cyclone dust-collecting apparatus of claim 1, wherein the tertiary cyclone unit is disposed perpendicular to the primary and secondary cyclone units.

3. The cyclone dust-collecting apparatus of claim 1, wherein the skirt comprises a portion that is cut out so that large dust passes through the cut-out portion.

4. The cyclone dust-collecting apparatus of claim 1, wherein the cylindrical-shaped body comprises a dust discharge cover to open or close an open bottom portion of the cylindrical-shaped body.

5. The cyclone dust-collecting apparatus of claim 1, wherein the secondary cyclone unit comprises:

a secondary cyclone air discharge pipe disposed inside the grill pipe and fluidly communicating with the tertiary cyclone unit;

a plurality of guide wings disposed at regular intervals along an outer circumference of the secondary cyclone air discharge pipe; and an isolation pipe disposed below the secondary cyclone air discharge pipe to isolate a lower space inside the cylindrical-shaped body.

6. The cyclone dust-collecting apparatus of claim 5, wherein the plurality of guide wings are arranged on the same level on the outer circumference of the secondary cyclone air discharge pipe.

7. The cyclone dust-collecting apparatus of claim 5, wherein the plurality of guide wings are disposed at a lower end of the outer circumference of the secondary cyclone air discharge pipe.

8. The cyclone dust-collecting apparatus of claim 1, wherein the tertiary cyclone unit comprises:

a dual cyclone unit having at least one pair of cyclone chambers disposed symmetrically thereinside;

a discharge unit disposed on a first side of the dual cyclone unit to collect air discharged from the pair of cyclone chambers and discharge the air from the tertiary cyclone unit; and a dust-collecting unit disposed on an outer circumference of the cylindrical-shaped body and fluidly communicating with the dual cyclone unit.

9. The cyclone dust-collecting apparatus of claim 8, wherein the tertiary cyclone unit further comprises a cover detachably mounted to the dual cyclone unit to open and close the tertiary cyclone unit, the cover having a pair of cylindrical-shaped stabilizers, which are disposed coaxially with a pair of tertiary cyclone air discharge pipes disposed on a second side of the dual cyclone unit.

10. The cyclone dust-collecting apparatus of claim 8, wherein the discharge unit comprises an outlet disposed on one side thereof, and wherein the outlet comprises a filter mounted thereinside.

11. A cyclone dust-collecting apparatus to separate dust from air using a centrifugal force and to collect the separated dust, the cyclone dust-collecting apparatus comprising:

at least two vertical cyclone units disposed overlappingly; and a horizontal cyclone unit comprising at least two cyclone chambers disposed parallel to each other and perpendicular to the at least two vertical cyclone units, wherein the at least two vertical cyclone units comprise a grill pipe to simultaneously function as an air outflow opening of one of the at least two vertical cyclone units and as an air inflow opening of the other of the at least two vertical cyclone units, and wherein the grill pipe comprises a skirt extending outwards from a bottom end thereof and having a plurality of filter pores.

12. The cyclone dust-collecting apparatus of claim 11, wherein one of the at least two vertical cyclone units comprises an air outflow opening that functions as an air inflow opening of the other of the at least two vertical cyclone units.

13. A cyclone dust-collecting apparatus to separate dust from air using a centrifugal force and to collect the separated dust, the cyclone dust-collecting apparatus comprising:

at least two vertical cyclone units disposed overlappingly; and a horizontal cyclone unit comprising at least two cyclone chambers disposed parallel to each other and perpendicular to the at least two vertical cyclone units, wherein one of the at least two vertical cyclone units fluidly communicates with an air discharge pipe of the horizontal cyclone unit, and wherein the air discharge pipe comprises a plurality of guide wings disposed at regular intervals along an outer circumference of the air discharge pipe.

* * * * *